US006199517B1

(12) United States Patent
Genster et al.

(10) Patent No.: US 6,199,517 B1
(45) Date of Patent: Mar. 13, 2001

(54) LATENT HEAT STORAGE SYSTEM FOR USE IN A VEHICLE

(75) Inventors: Albert Genster, Marl; Hansjürgen Kech, Herdecke; Horst-Georg Schmalfuss, Meinerzhagen; Gerhard Hunnekuhl, Witten, all of (DE)

(73) Assignee: Wilo GmbH, Dortmund (DE)

( * ) Notice: Subject to any disclaimer, the term of this patent is extended or adjusted under 35 U.S.C. 154(b) by 0 days.

(21) Appl. No.: 09/424,327

(22) PCT Filed: Jul. 31, 1997

(86) PCT No.: PCT/EP97/04646

§ 371 Date: Nov. 19, 1999

§ 102(e) Date: Nov. 19, 1999

(87) PCT Pub. No.: WO99/06234

PCT Pub. Date: Feb. 11, 1999

(51) Int. Cl.[7] ..... F01P 11/02

(52) U.S. Cl. ..... 123/41.14; 165/902

(58) Field of Search ..... 123/41.14, 41.44; 165/902, DIG. 539

(56) References Cited

U.S. PATENT DOCUMENTS 1,346,331 * 7/1920 Muir ..... 123/41.14

* cited by examiner

*Primary Examiner*—Noah P. Kamen
(74) *Attorney, Agent, or Firm*—Herbert Dubno; Andrew Wilford

(57) ABSTRACT

The invention relates to a latent heat storage system for use on the cooling-water circuit of a vehicle combustion engine, whereby a motor-driven rotary pump is secured either at the edge of the storage system housing or inside said housing.

8 Claims, 1 Drawing Sheet

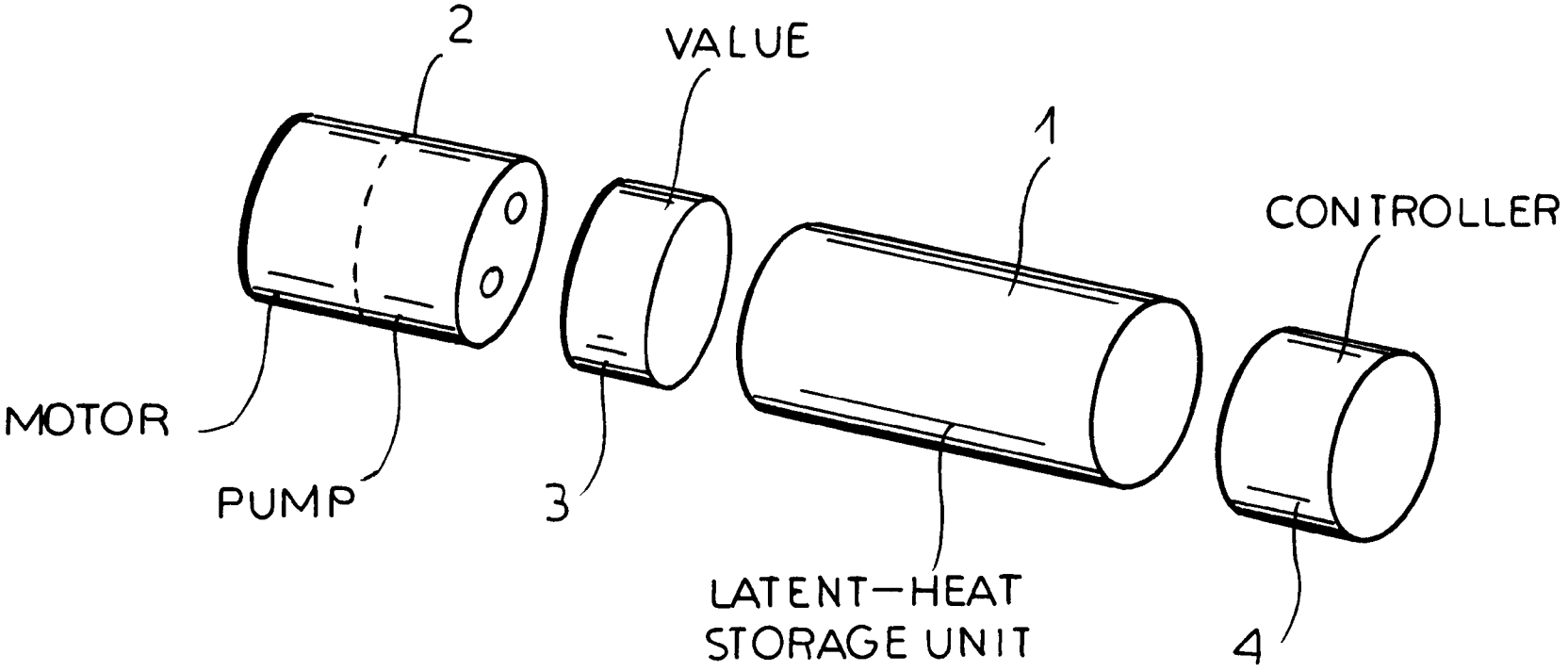
CONTROLLER
4
1
LATENT-HEAT
STORAGE UNIT
VALUE
3
2
PUMP
MOTOR

LATENT HEAT STORAGE SYSTEM FOR USE IN A VEHICLE

CROSS REFERENCE TO RELATED APPLICATIONS

This is the US national phase of PCT application PCT/EP97/04646 filed Jul. 31, 1997.

FIELD OF THE INVENTION

It is known to put in the coolant-circulation system of a motor-vehicle internal-combustion engine a cooler, a heater/air-conditioner, and a latent-heat storage device. The coolant is 5 circulated by a pump and the motor, cooler, heater, and latent-heat storage device form in the engine compartment of the motor vehicle along with the pump for the coolant system separate units that must be mounted one after the other in the engine compartment.

OBJECTS OF THE INVENTION

It is an object of the invention to simplify the manufacture, installation, and repair, in particular also the exchange of the parts, of a coolant system and to make them less expensive while also saving space.

SUMMARY OF THE INVENTION

This object is achieved according to the invention in that a motor-driven centrifugal pump is mounted in or on the Latent-heat storage unit.

Thus the latent-heat storage unit and the pump form a single module which substantially simplifies its manufacture and installation. In addition repairs are made easier and less space is needed in the engine compartment.

It is particularly advantageous when the pump is mounted on an end of the latent-heat storage unit. It is also from the point of view of manufacture and saving of space advantageous when a side of the pump housing turned away from the motor has a planar connecting face with input and output ports and serves for mounting the pump on the latent-heat storage unit or an intermediate device. A disk forming an intermediate device can be mounted between the connecting face and the pump and/or the latent-heat storage unit and has a hydraulic distributor and/or a valve (in particular a three-way valve).

A particularly advantage use of the pump is achieved when the pump is a tubular pump whose rotor is axially traversed by coolant. The electric motor of the pump can have a magnetic rotor so that the pump takes up very little space and can be mounted on the adjacent devices like a disk.

Further integration and reduction of space is achieved when an end of the pump and/or of the latent-heat storage unit carries a housing of the intermediate device that holds electronic control parts.

BRIEF DESCRIPTION OF THE DRAWING

An embodiment of the invention is shown in exploded perspective view in the drawing and is described more closely in the following.

SPECIFIC DESCRIPTION

An in particular cylindrical latent-heat storage unit 1 is connected in a coolant-water circuit of a motor-vehicle internal-combustion engine directly on the end or via an intermediate assembly to a motor pump, in particular a canned-motor pump 2. The intermediate assembly can be an electronic DEVICE 4 or hydraulic device 3. Here the latent-heat storage unit 1, motor pump 2, and possible intermediate assemblies 3 and 4 form a single module that can be mounted inside another module through which the coolant is circulated.

The motor pump 2 is either a tubular pump or a canned-motor pump whose housing has turned away from the electric motor a planar connecting face with input and output ports. This connecting face is used to secure the pump to the latent-heat storage unit 1.

It is possible to connect between the motor pump 2 and the latent-heat storage unit 1 a disk-shaped hydraulic manifold and/or a valve 3, in particular a three-way valve, that is operated by an electronic controller 4. The controller 4 is inside a housing that has the electronic elements for controlling the pump 2 and/or the heat-storage unit 1 and is mounted on the end of the motor pump 2 and/or of the latent-heat storage unit 1.

In accordance with further alternatives, the motor of the motor pump 5 can have a magnetic rotor so that the motor pump is particularly short axially. In addition the devices 3 and 4 can be mounted on the end of the latent-heat storage unit 1 which is opposite to the pump 2. The pump 2 can also be a tubular pump.

What is claimed is:

1. A latent-heat storage unit for the coolant-water system of a motor-vehicle internal-combustion engine comprising a motor; and a centrifugal pump driven by the motor and having a housing with a side turned away from the motor and having a planar connecting face provided with input and output ports and by which the pump is mounted on the latent-heat storage unit.

2. The latent-heat storage unit according to claim 1 wherein the latent-heat storage unit and the pump form a single module.

3. The latent-heat storage unit according to claim 1 wherein the pump is mounted on an end of the latent-heat storage unit.

4. The latent-heat storage unit according to claim 1, further comprising a disk forming an intermediate device and mounted between the connecting face and the latent-heat storage unit and having a hydraulic device.

5. The latent-heat storage unit according to claim 1 wherein the pump is a canned-motor pump.

6. The latent-heat storage unit according to claim 1 wherein the pump is a tubular pump having a rotor axially traversed by coolant.

7. The latent-heat storage unit according to claim 1 wherein the motor of the pump has a magnetic rotor.

8. The latent-heat storage unit according to claim 1, further comprising an intermediate device between an end of the pump and the latent-heat storage unit and having a housing that holds electronic control parts.

* * * * *